US005116055A

United States Patent [19]

Tracy

[11] Patent Number: 5,116,055

[45] Date of Patent: May 26, 1992

[54] PROGRESSIVE JACKPOT GAMING SYSTEM LINKING GAMING MACHINES WITH DIFFERENT HIT FREQUENCIES AND DENOMINATIONS

[75] Inventor: Daniel A. Tracy, Las Vegas, Nev.

[73] Assignee: Mikohn, Inc., Las Vegas, Nev.

[21] Appl. No.: 725,001

[22] Filed: Jul. 2, 1991

[51] Int. Cl.[5] ..... A63F 5/04
[52] U.S. Cl. ..... 273/138 A; 273/143 R
[58] Field of Search ..... 273/138 A, 193 R

[56] References Cited

U.S. PATENT DOCUMENTS 4,837,728 6/1989 Barrie et al. ..... 273/143 R
4,964,638 10/1990 Ishida ..... 273/143 R

*Primary Examiner*—Benjamin Layno
*Attorney, Agent, or Firm*—Robin, Blecker, Daley & Driscoll

[57] ABSTRACT

A progressive gaming system in which the gaming machines linked to the system have different play characteristics, e.g. different Denominations and Hit Frequencies, and wherein the system is further adapted such that the dollars contributed to the progressive jackpot for a machine per win on that machine is approximately equal for the different machines.

18 Claims, 4 Drawing Sheets

| Game Type | No. of Stops | Hits/ Cycle | Hit Freq. | Den. | Coins | Total Bet | $s Bet Per Win | Coins/ Pulse | % To J P | Unit Incra/ Pulse | $s To J P | Reset % |
|---|---|---|---|---|---|---|---|---|---|---|---|---|
| Poker | — | — | 40,000 | $5.00 | 5 | $25.00 | $1,000,000. | 4 | 0.25% (.0025) | $.05 | $2500. | 2.0 |
| 3 Reel Slot | 128 | 6 | 349,525 | $1.00 | 3 | $3.00 | $1,048,576. | 21 | 0.24% (.0024) | $.05 | $2496. | 1.9 |
| 3 Reel Slot | 128 | 1 | 2,097,152 | $.25 | 3 | $.75 | $1,572,864. | 124 | 0.16 % (.0016) | $.05 | $2537. | 1.3 |
| 4 Reel Slot | 64 | 1 | 16,777,216 | $.05 | 3 | $.15 | $2,516,582. | 1000 | 0.10 % (.0010) | $.05 | $2516. | 0.8 |

FIG. 2

| Game Type | No. of Stops | Hit Freq. | Den. | Coins | Total Bet | $s Bet Per Win | Total Coins In | Coins/ Pulse | % To JP | Unit Incra/ Pulse | $s To JP |
|---|---|---|---|---|---|---|---|---|---|---|---|
| Draw Poker | — | 40,000 | $5.00 | 5 | $25 | $1,000,000 | 200,000 | 2 | 0.5 % | $.05 | $5,000.00 |
| Three Reel Slot | 64 | 262,144 | $1.00 | 5 | $5 | $1,310,720 | 1,310,720 | 10 | 0.5 % | $.05 | $5,242.98 |
| Four Reel Slot | 32 | 1048576 | $0.25 | 5 | $1.25 | $1,310,720 | 5,242,880 | 50 | 0.5 % | $.05 | $5,242.98 |

FIG. 3

| Game Type | No. of Stops | Hit Freq. | Den. | Coins | Total Bet | $s Bet Per Win | Total Coins In | Coins/ Pulse | % To JP | Unit Incra/ Pulse | $s To JP |
|---|---|---|---|---|---|---|---|---|---|---|---|
| Draw Poker | — | 40,000 | $1.00 | 5 | $5.00 | $200,000 | 200,000 | 2 | .5 % | $.01 | $1,000 |
| Three Reel Slot | 64 | 262,144 | $.25 | 3 | $.75 | $196,608 | 786,432 | 8 | .5 % | $.01 | $983 |
| Four Reel Slot | 32 | 1048576 | $.05 | 5 | $.25 | $262,144 | 5,242,880 | 50 | .4 % | $.01 | $1,048 |

FIG. 4

PROGRESSIVE JACKPOT GAMING SYSTEM LINKING GAMING MACHINES WITH DIFFERENT HIT FREQUENCIES AND DENOMINATIONS

BACKGROUND OF THE INVENTION

This invention relates to gaming systems and, in particular, to progressive jackpot gaming systems.

Progressive jackpot gaming systems are in use today in which a plurality of gaming machines are linked together to form a progressive system. In this type of system, a percentage of game play on each of the gaming machines is used to determine the progressive jackpot value. As a result, the progressive jackpot value continually increases until a win or hit occurs at one of the linked machines on the system. At this time, the progressive jackpot is paid out to the machine showing the hit jackpot and the system resets, usually to a base jackpot value, and then again begins incrementing the jackpot value based on game play. This procedure then repeats as jackpots are won and game play continues.

In existing progressives systems, calculation of the progressive jackpot value and the monitoring of hit jackpots is typically carried out using a progressive controller which links the gaming machines. The progressive controller monitors the coin/pulse and jackpot/pulse information of each gaming machine to determine the monetary amount being played as well as whether a jackpot has been hit. This information is then used by the controller to increment the progressive jackpot value and to report the incremented value to a visible common display as well as to a display on each machine. The progressive controller also monitors jackpot wins so as to acknowledge the winning of the progressive jackpot and, thereafter, to reset the jackpot to the base amount for continued incrementing based on subsequent game play.

It is typical in the above progressive jackpot systems to link only gaming machines of the same type, i.e., those having substantially the same play characteristics. Thus, the gaming machines on a given link will typically accept the same monetary value or coin for game play, i.e., will be of the same Denomination. They also will usually require the same number of coins-in, i.e., the same Coins-In to qualify for or buy-into the progressive jackpot. Additionally, the number of games played per win of the progressive jackpot, i.e., the Hit Frequency, for each machine will be the same. Finally, the percentage of game play applied or contributed to the progressive jackpot, i.e., the % to JP, by the progressive controller will be equal for all machines.

By requiring the use of machines with like Denominations, Coins-In, Hit Frequencies, % to JP and other like play characteristics on a progressive link, the progressive system tends to treat players at the different machines on the same basis. Accordingly, an overall substantially fair system is realized.

While the above progressive systems have proved successful, there is still a desire to increase player interest in using the systems. Thus, makers of progressive systems are continually looking for variations to the system which can stimulate game play, but which at the same time preserve a reasonable degree of fairness to the players using the system.

It is therefore an object of the present invention to provide a progressive system which provides increased player interest.

It is a further object of the present invention to provide a progressive system which is designed to increase player interest while maintaining a reasonable degree of fairness to the players using the system.

SUMMARY OF THE INVENTION

In accordance with the principles of the present invention, the above and other objectives are realized in a progressive system in which a plurality of different gaming machines are utilized having one or more different play characteristics, e.g., different Denominations and Hit Frequencies, and wherein the system is adapted such that the total dollar amount contributed by a machine to the progressive jackpot per win of the jackpot on the machine, defined as the $s To JP, is approximately equal for the different machines.

With the progressive gaming system designed as aforesaid, play is stimulated by having machines with different play characteristics on the same link. Moreover, by controlling the system such that the $s To JP for the different machines is approximately equal, a measure of fairness is preserved for the players at the different machines.

In the embodiment of the invention to be disclosed hereinafter, the $s to JP of the different machines is made approximately equal by arranging an electronic translator between each machine and a progressive controller which is used to determine the jackpot value and control the system. Each translator adjusts the coin/pulse information from its respective gaming machine such that the % To JP of the machine provides a $s to JP for the machine which approximates that of the other gaming machines. Each translator, furthermore, may be used to adjust the protocol of the coin/pulse information and the jackpot/pulse information of its respective gaming machine such that a common protocol is used for information transmission to the system controller.

In some of the embodiments of the invention to be disclosed hereinafter, the play characteristics of each gaming machine, e.g., Denomination, Hit Frequency and Coins-In are further controlled so that machines with higher Hit Frequencies and lower Denominations require a higher amount of total money to be played per win or hit of the progressive jackpot (defined as the $s Bet Per Win). In some applications, it may also be desirable to attempt to equalize the $s Bet Per Win of each machine.

BRIEF DESCRIPTION OF THE DRAWINGS

The above and other features and aspects of the present invention will become more apparent upon reading the following detailed description in conjunction with the accompanying drawings, in which:

FIGS. 2, 3 and 4 show representative sets of characteristics for the gaming machines and the progressive controller of the system of FIG. 1.

DETAILED DESCRIPTION

Figure 1:
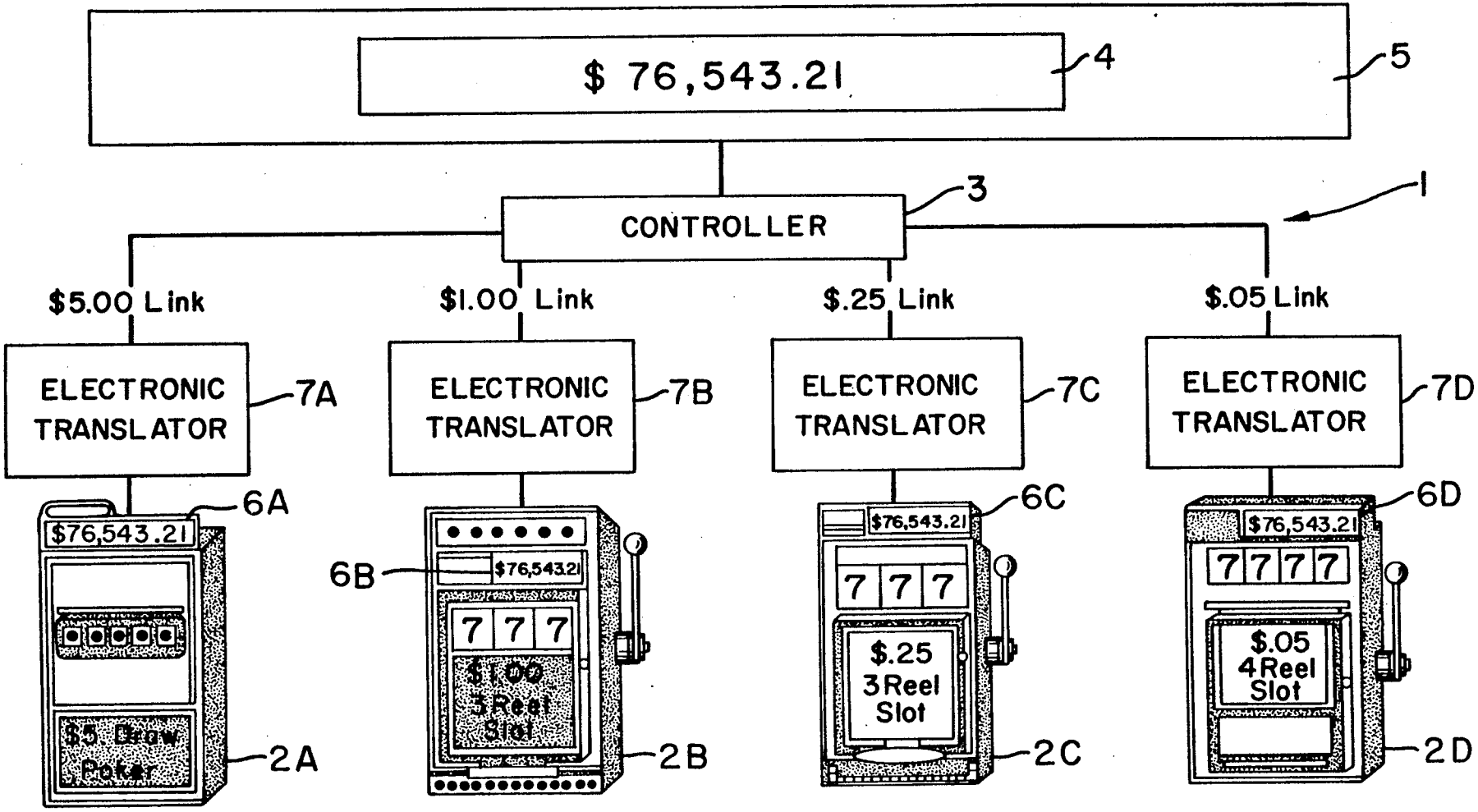
FIG. 1 shows a progressive gaming system in accordance with the principles of the present invention.

FIG. 1 shows a progressive jackpot gaming system 1 in accordance with the principles of the present invention. The gaming system comprises a plurality of gaming machines, shown as 2A, 2B, 2C and 2D which, in accord with the invention, have different play characteristics, e.g., different Denominations and different Hit Frequencies.

In the case shown, the gaming machine 2A is a draw poker machine having a Denomination of $5 and a Hit Frequency $HF_{80}$. The devices 2B and 2C, in turn, are each shown as three reel slot machines with respective Denominations of $1 and $0.25 and hit frequencies $HF_B$ and $HF_C$. Finally, the device 2D is illustrated as a four reel slot machine with a $.05 Denomination and a Hit Frequency $HF_D$.

Each of the machines 2A-2D is further adapted to permit a player on the machine to participate in a progressive jackpot JP by the insertion of a Coins-In number of coins into the respective machine. In the case shown, it is assumed that the Coins-In for machine 2A is equal to five and the Coins-In for the machines 2B-2D is equal to three. Thus, the monetary amounts required to participate in the progressive JP (i.e. the Buy-Ins) for the machines 2A-2D are $25, $3, $0.75 and $0.15, respectively.

Each of the machines 2A-2D provides coin/pulse information and jackpot/pulse information to a progressive controller 3 which is adapted to control the progressive system. Thus, the controller 3 controls the progressive jackpot value 4, displayed on a common display 5 and, in the case shown, on displays 6A-6D on each machine, based upon the coin/pulse information supplied by the gaming machines.

In particular, as discussed more fully below, the progressive controller 3, based upon the coin/pulse information supplied, calculates and updates the progressive jackpot value 4 and changes the displays accordingly. The controller 3 also monitors the jackpot/pulse information from each of the gaming machines and resets the progressive jackpot value when the progressive jackpot is won at any one of the machines. The reset value may be set at some fixed base amount or a fixed base amount plus a percentage of game play from which the controller again increments the jackpot based on game play. A controller which can be adapted to carry out the aforesaid functions and those described below is presently being sold by Mikohn, Inc. under Model designations Con II, Versions A, AF, I and IF.

In accordance with the principles of the present invention, the system 1 is further adapted such that the $s To JP per win on each of the machines 2A-2D is approximately equal for the different machines. This ensures a reasonable degree of fairness to the players at the different machines, while the use of different machines itself promotes player interest and stimulates game play. The system 1 thus provides an overall improved progressive system which preserves fairness to the players playing the system and reduces the jackpot liability, i.e., the amount of money available to be won at a location.

To achieve the above result of the $s To JP of each gaming machine being approximately equal, the parameters of the gaming machines 2A-2D, e.g., the Hit Frequencies, the parameters of the controller 3 and/or the other parameters of the system, e.g., the % to JP, can be suitably selected and adjusted. In the present illustrative case, the latter parameter, i.e., the % to JP, is controlled for each gaming machine to realize the desired approximate equality of $s to JP. Furthermore, this is achieved by using electronic translators 7A-7D between the respective gaming machines 2A-2D and the controller 3.

More particularly, in the present example, it is assumed that each gaming machine 2A-2D provides a pulse of coin information for each coin Denomination which is accepted by a machine and applied to the progressive jackpot, i.e., for each coin of the Coins-In for the machine. Thus, the Coins/Pulse value for each machine is one. It is also assumed that the controller 3 is set to provide a constant increment to the progressive jackpot for each pulse of coin information received, i.e., a constant Unit Incra/Pulse which might for example be equal to $0.05 per pulse.

Accordingly, with the Coins/Pulse value of each machine set at one and the Unit Incra/Pulse set at a constant, i.e., $0.05 in the present case, each electronic translator 7A to 7D establishes an adjusted Coins/Pulse value for its respective gaming machine. These adjusted Coins/Pulse values are set to achieve the desired % To JP for each machine and are then used by the translators to generate coin pulse information for the controller 3. This, in turn, results in the $s To JP for the different machines being approximately equal.

More particularly, it can be shown that the $s To JP and % To JP for each of the gaming machine 2A-2D are related by the following expressions:

$$\$s\ To\ JP = (\$s\ Bet\ To\ Win)\ (\%\ To\ JP) \quad (1)$$

$$\%\ To\ JP = \$s\ To\ JP/(\$s\ Bet\ To\ Win) \quad (2)$$

$$\%\ To\ JP = (Unit\ Incra/Pulse)/[(Denomination)(Coins/Pulse)] \quad (3)$$

where $$\$s\ Bet\ To\ Win = (Denomination)(Coins\text{-}In)\ (Hit\ Frequency) \quad (4)$$

Solving the above for the Coins/Pulse in terms $s To JP we have $$(Coins/Pulse) = \frac{(Unit\ Incra/Pulse)\ (Coins\text{-}In)\ (Hit\ Frequency)}{\$s\ To\ JP} \quad (5)$$

Thus, each translator 7A to 7D adjusts the coin/pulse information received from its respective gaming machine so that coin pulses delivered to the controller 3 satisfy the Coins/Pulse value given by expression (5) above. This then allows an approximate equality to be achieved for the $s To JP for each machine.

The translators 7A to 7D can also serve to adjust the protocol of the coin/pulse information received from the different machines so that coin pulses of a common protocol are transmitted to the controller. Thus, if the machines are using different pulse widths to indicate presence of a coin, the translators can adjust these different protocols such that a common pulse width is fed to the controller to signify a coin-in. Similarly, the translators can adjust the protocols of the jackpot/pulse information fed by the machines to the controller so that a common protocol is also used for this information.

FIG. 2 shows representative parameters of a system 1 designed in accordance with above. As can be seen, the Hit Frequencies of the machines 2A-2D are different and increase for machines of decreasing Denomination. The Coins-In for of the machines have been set, as set forth above, and they result in a $s Bet Per Hit or Win which is higher for machines of lower Denomination and higher Hit Frequency.

The $s To JP for the machines, in turn, are approximately equal at about $2500 with an equal Unit Incra/-Pulse of $0.05. To achieve this approximate equality, the effective % To JP of the machines have been accordingly adjusted by selection of different Coins/Pulse requirements of the respective translators 7A–7D.

As above noted, in this example, the system 1 has been designed so that the $s Bet Per Win of the gaming machines 2A–2D is higher for machines of higher Hit Frequency and lower Denomination. In some applications, it may be desirable to adjust the $s Bet per Win of the different machines to also be approximately equal or to have some other desired relationship. This can be effected, for example, by suitable adjustment of the Hit Frequencies of the machines.

FIGS. 2 and 3 show other representative parameters of systems 1 designed in accordance with the principles of the present invention. Again to achieve approximate equality of the $To JP in each of these representative systems, the % to JP of the machines of these systems have been suitably adjusted by selection of appropriate Coins/Pulse of the respective translators 7A–7B.

In the present illustrative case, the electronic translators 7A–7D have been shown as separate units. However, the translators and/or their functions can be incorporated into the controller 3 and/or in the respective gaming machines 2A–2D. Moreover, translators need not be used, if a separate Unit Incra/Pulse is provided in the controller for the different gaming machines.

It should be further noted that the term approximately equal, as used herein in conjunction with the $s To JP, is intended to mean that the $s To JP of each of the gaming machines preferably differ by less than about 5% and, more, preferably by less than about 1%.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A progressive jackpot system comprising:

a plurality of gaming machines, each gaming machine being able to buy-into the progressive jackpot and each having one or more different play characteristics; and means responsive to each of said gaming machines for determining the progressive jackpot value based upon the play at each of said gaming machines, said determination being such that the $s To JP of each gaming machine per win of the progressive jackpot at each gaming machine is approximately equal for the different machines.

2. A progressive jackpot system in accordance with claim 1 wherein:

said one or more different play characteristics include a different Denomination and a different Hit Frequency.

3. A progressive jackpot system in accordance with claim 2 wherein:

the $s Bet To Win for the progressive jackpot for each gaming machine is higher for gaming machines of lower Denomination and higher Hit Frequency.

4. A progressive jackpot system in accordance with claim 2 wherein:

the $s Bet To Win for the progressive jackpot for each gaming machine is approximately equal for the different gaming machines.

5. A progressive jackpot system in accordance with claim 2 wherein:

the $s To JP of the gaming machines differ from one another by less than about 5%.

6. A progressive jackpot system in accordance with claim 5 wherein:

the $s To JP of the gaming machines differ from one another by less than about 1%.

7. A progressive jackpot system in accordance with claim 2 wherein:

said determining means uses preselected effective %s To JP for the play o the different machines to obtain approximate equality of said $s To JP for the different machines.

8. A progressive jackpot system in accordance with claim 7 wherein:

each gaming machine generates coin/pulse information based upon a preselected Coins/Pulse value;

and said determining means includes means for adjusting said coin/pulse information of each gaming machine in accordance with a further Coins/Pulse value for that gaming machine based upon the effective % To JP for that gaming machine.

9. A progressive system in accordance with claim 8 wherein:

said adjusting mean further adjusts the coin/pulse information of each gaming machine such that the coin/pulse information of the different gaming machines has a common protocol.

10. A method for providing a progressive jackpot comprising:

linking a plurality of gaming machines each of which is able to buy-into a progressive jackpot, each gaming machine having one or more different play characteristics; and determining the progressive jackpot value based upon the play at each of said gaming machines, said determination being such that the $s To JP of each gaming machine per win of the progressive jackpot at each gaming machine is approximately equal for the different machines.

11. A method in accordance with claim 1 wherein:

said one or more different play characteristics include a different Denomination and a different Hit Frequency.

12. A method in accordance with claim 11 wherein:

the $s Bet T Win for the progressive jackpot for each gaming machine is higher for gaming machines of lower Denomination and higher Hit Frequency.

13. A method in accordance with claim 11 wherein:

the $s Bet To Win for the progressive jackpot for each gaming machine is approximately equal for the different gaming machines.

14. A method in accordance with claim 11 wherein:

the $s To JP of the gaming machines differ from one another by less than about 5%.

15. A method in accordance with claim 14 wherein:

the $s To JP of the gaming machines differ from one another by less than about 1%.

16. A method in accordance with claim 11 wherein:

said step of determining uses preselected effective %s To JP for the play on the different machines to obtain approximate equality of said $s To JP for the different machines.

17. A method in accordance with claim 16 wherein:

each gaming machine generates coin/pulse information based upon a preselected Coins/Pulse value;

and said determining step includes adjusting said coin/pulse information of each gaming machine in accordance with a further Coins/Pulse value for that gaming machine based upon the effective % To JP for that gaming machine.

18. A method in accordance with claim 17 wherein: said adjusting step further adjusts the coin/pulse information of each gaming machine such that the coin/pulse information of the different gaming machines has a common protocol.

* * * * *

UNITED STATES PATENT AND TRADEMARK OFFICE

CERTIFICATE OF CORRECTION

PATENT NO. : 5,116,055

DATED : May 26, 1992

INVENTOR(S) : Daniel A. Tracy

It is certified that error appears in the above-identified patent and that said Letters Patent is hereby corrected as shown below:

Col. 3, line 6. Change "$HF_{80}$" to -- $HF_A$ --

Col. 6, line 15. Change "o" to -- on --

Col. 6, line 50. Change "T" to -- To --

Signed and Sealed this

Twenty-fourth Day of August, 1993

Bruce Lehman

*Attest:*

BRUCE LEHMAN

*Attesting Officer*

*Commissioner of Patents and Trademarks*